US006101632A

United States Patent [19]

Veazey

[11] Patent Number: 6,101,632

[45] Date of Patent: Aug. 15, 2000

[54] FOLDABLE PROTECTIVE HATS

[75] Inventor: Sidney E. Veazey, King George, Va.

[73] Assignee: S E Ventures, Inc., King George, Va.

[21] Appl. No.: 08/879,623

[22] Filed: Jun. 20, 1997

Related U.S. Application Data

[60] Continuation-in-part of application No. 08/610,368, Mar. 4, 1996, Pat. No. 5,736,954, which is a division of application No. 08/129,770, Sep. 30, 1993, Pat. No. 5,530,445.

[51] Int. Cl.[7] ..... A42B 1/00

[52] U.S. Cl. ..... 2/175.5; 2/209.13

[58] Field of Search ..... 2/175.5, 209.13, 2/200.1, 906; 362/106

[56] References Cited

U.S. PATENT DOCUMENTS

| | | | |
|---|---|---|---|
| 2,663,024 | 12/1953 | Cantor | 2/175.5 |
| 3,217,325 | 11/1965 | Mullin | 342/10 |
| 3,224,001 | 12/1965 | Rudnofsky et al. | 342/10 |
| 3,749,337 | 7/1973 | Jalbert . | |
| 4,017,908 | 4/1977 | Murnane | 2/114 |
| 4,149,304 | 4/1979 | Brynjegard | 29/148.4 |
| 4,178,867 | 12/1979 | Shyu . | |
| 4,497,272 | 2/1985 | Veazey . | |
| 4,553,037 | 11/1985 | Veazey . | |
| 4,598,661 | 7/1986 | Roe | 116/209 |
| 4,729,530 | 3/1988 | Jalbert . | |
| 4,768,739 | 9/1988 | Schnee | 244/146 |
| 4,899,039 | 2/1990 | Taylor et al. | 2/209.13 |
| 4,999,851 | 3/1991 | Hall | 2/175.5 |
| 5,046,193 | 9/1991 | Foresman et al. | 2/68 |
| 5,174,529 | 12/1992 | Jalbert . | |
| 5,326,297 | 7/1994 | Loughlin | 441/89 |
| 5,530,445 | 6/1996 | Veazey | 342/8 |
| 5,530,970 | 7/1996 | Knutson | 2/209.13 |
| 5,657,490 | 8/1997 | Edmark | 2/175.5 |
| 5,736,954 | 4/1998 | Veazey | 342/8 |
| 5,857,219 | 1/1999 | Edmark | 2/175.5 |

OTHER PUBLICATIONS

Undated ad—*Safari Hat,* Pacific Sportswear Co.

Twist–Away Safari Hat Price Sheet, undated.

"Safari Hat," *Potentials in Marketing*, Nov. 1996,p. 56.

S. E. Veazey & Prof. M. Saarlas, Rept. EW–11–83, "Mastless Sails" (1982), U. S. Naval Academy Div. Of Engineering & Weapons.

*Primary Examiner*—Bibhu Mohanty

*Attorney, Agent, or Firm*—James K. Poole

[57] ABSTRACT

Protective hats having a crown and broad brim provide protection from the sun and by surfaces reflecting light and/or radar waves provide distress signalling means. The hats can be colored international orange for enhancing their usefulness as a distress signal. Due to stiffening means such as a springy hoop of suitable material contained within the peripheral binder of the hat's brim, it can be easily folded into a small package for storage or carrying on the person.

32 Claims, 9 Drawing Sheets

FOLDABLE PROTECTIVE HATS

REFERENCE TO RELATED APPLICATIONS

This application is a continuation-in-part of Applicant's SEV-3DIV, U.S. Ser. No. 08/610,368, filed Mar. 4, 1996 now U.S. Pat. No. 5,736,954 which is a divisional application of his SEV-3, U.S. Ser. No. 08/129,770, filed Sep. 30, 1993 now U.S. Pat. No. 5,530,445. U.S. Ser. No. 08/610,368 is incorporated herein by reference.

BACKGROUND OF THE INVENTION

1. Field of the Invention

The present invention relates to protective hats which are foldable and can also serve as distress signals. The parent and grandparent applications of the present application disclose and claim various parafoil-borne distress signals. Protective hats which also can serve as distress signals are disclosed.

2. Description of the Prior Art

Outdoor sports are becoming increasingly popular, but at the same time there is also increasing awareness that exposure to the sun's rays without proper protection increases the risk of skin cancer. Many people spending time on the beach or other outdoor recreation sites wear large hats to protect the face and neck from the sun, but such hats are sometimes inconvenient to carry or store. Hats which can also serve as distress signals are becoming popular with hikers, boaters and others spending time in outdoor areas where they may become lost. Also, hats which reflect body heat from within help to prevent hypothermia in cold weather. Hats which can be compactly stored until needed are useful in such applications.

SUMMARY OF THE INVENTION

An object of the invention is to provide hats which will serve to protect the wearer from exposure to sunlight, cold and/or rain and also provide at least a visible distress signal. Another object is to provide a radar target. A further object is to provide convenient, compact and economical means for recreational boaters and other outdoor sportsmen to easily carry such hats.

These and other objects and advantages of the present invention will be apparent to those skilled in the art upon perusing the following detailed description, including the drawings, specification and appended claims.

According to the present invention, these and other objects can be achieved by providing a protective foldable hat having a collapsible crown and a broad brim surrounding same, the brim containing stiffening means such as a springy hoop, a stiff but bendable wire or an inflatable tube in the peripheral binder thereof. Additional stiffening means of the same types can be provided inside the crown of the hat and/or on the exterior of the brim. The hat can comprise radar reflective material, and in a preferred embodiment incorporates at least one radar reflector having three mutually orthogonal planar surfaces of radar reflective material which may also serve to support the flexible brim in a horizontal plane when worn. Because of the flexibility and springiness of the hoops in the binder of the hat's flexible brim, these hats can be conveniently folded to a small size, optionally encased in containing means, and conveniently stored or carried in a pocket, purse, life jacket or the like. The deflated tube or stiff but bendable wires allow the same type of folding. The hat can have fastening means for fastening distress signal means such as a strobe light and/or radar reflector to the crown thereof. Arrays of wires in proper geometrical arrangement can be included in the crown and/or brim to form an omnidirectional or directional radio antenna for an emergency radio transmitter or personal communication system.

BRIEF DESCRIPTION OF THE DRAWINGS

The invention is illustrated by the drawings, in which.

DETAILED DESCRIPTION OF THE INVENTION

Figure 1:
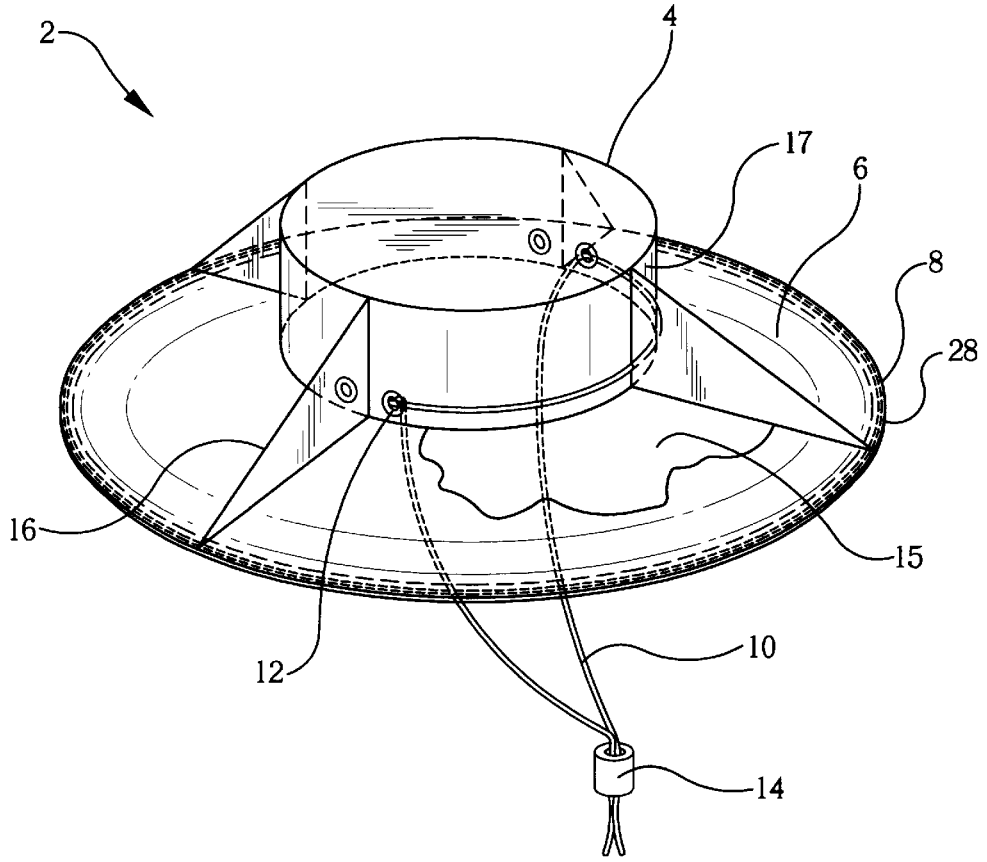
FIG. 1 shows a top perspective view of a hat of the invention.

Turning initially to the figures, FIG. 1 shows a hat (2) of the invention, having a collapsible crown (4) which in this case is cylindrical and a relatively broad brim (6) containing a springy hoop or inflatable tube (8) in the peripheral binder (28) therof. The crown can be any suitable shape in cross-section or profile, including polygonal shapes such as octagonal, but a cylindrical form with a flat top is presently preferred for the installation of various distress signals. A chin strap (10) extends through two holes (12) and around the crown as shown. A catch (14) can be used to fasten the chin strap under the wearer's chin. Optional triangular panels (16) extend from the crown to the brim, forming triangular segments which are approximately perpendicular to the brim and the adjacent vertical surfaces of the crown.

Radar-reflective material can be incorporated in the hat to make it an effective radar target, and Applicant has found that optimum results are obtained when radar reflective materials (e.g., aluminized Mylar or the like) are included in the natural structural features of the hat so as to form at least one set of three mutually orthogonal planes or surfaces. In a preferred embodiment, the triangular planes (16), the vertical surfaces of the crown (17) adjacent to triangular planes (16) and at least a portion (15) of the brim are made of radar-reflecting material to form such an orthogonal system. The remaining components of the hat are made of nylon, polyester, canvas or other flexible, relatively radar-permeable fabrics or films. This configuration provides for omnidirectional retroreflection of radar waves; in other words, radar waves striking the hat from any azimuth will be reflected back to the source. The terms "radar reflecting" and "radar-permeable" are used in a relative way, recognizing that most materials will both absorb or pass and reflect radar waves of various frequencies to varying degrees. The difference in the maritime context is observed by the fact that a radar reflecting material will provide a recognizable signal on a maritime surface search radar within range, while a radar-permeable material will not.

While the hat can be of any suitable color(s) or patterns to make a fashion statement, provide visibility or camouflage as required, white or light colors are preferred for good reflectivity of the sun's rays. The hat can incorporate metalized surfaces which also effectively reflect the sun's rays or a searchlight's beam and provide excellent visibility. For hats which are intended to provide a distress signal as well as sun protection, the color is preferably international or fluorescent orange.

Figure 2:
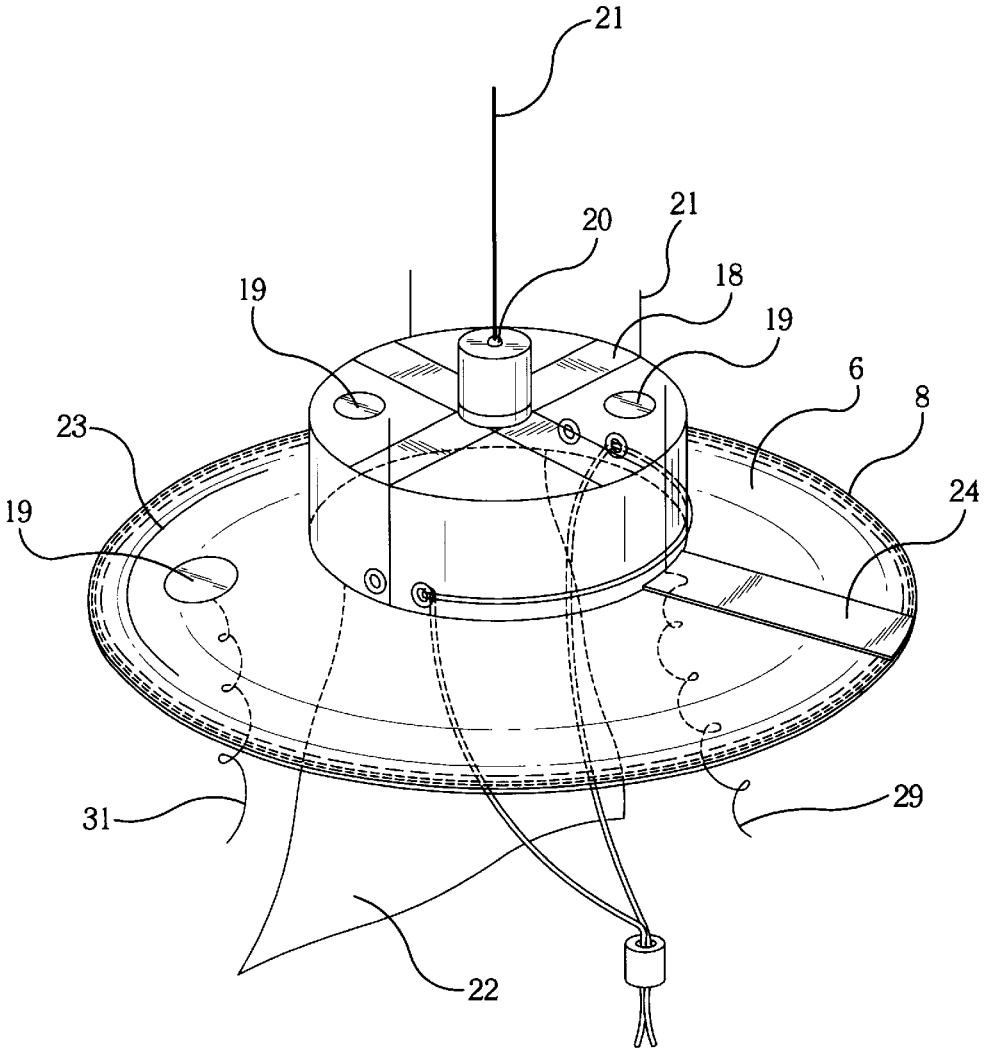
FIG. 2 shows a perspective view of the hat fitted with distress signalling devices.

FIG. 2 shows the hat without the optional triangular planes for clarity. At least one strip of material (18) providing fastening means is affixed to the top surface of the cylindrical crown. The fastening means can be loop and hook material such as VelcroTM, or any suitable material or fasteners. At least one signal means such as a strobe light, infrared emitter, separate radar reflector, radio antenna or small parabolic dish antenna (20) is affixed to the fastening means to mount the device atop the crown of the hat. The signal means can be any active or passive device using the electromagnetic spectrum to convey information, including but not limited to distress signals. Suitable radar reflectors are disclosed in the parent application, supra.

Figure 13:
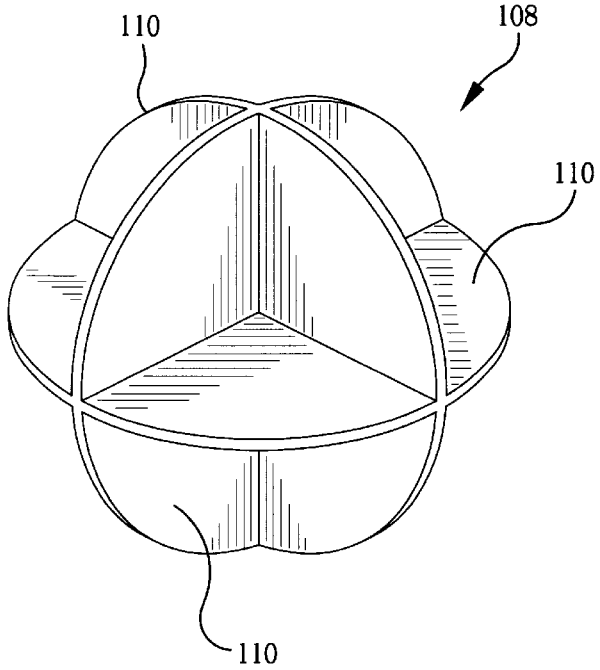
FIG. 13 shows a Davis radar reflector with orthogonal reflective surfaces.

FIG. 13 shows a folding orthogonal radar reflector 108 assembled. The three discs 110 of radar-reflective material interlock to form a set of three mutually orthogonal planes, all of them radar reflective. Such reflectors are commercially available in a variety of sizes, including, e.g. the Davis models for small boats. The result is to produce omnidirectional retroflection of radar waves, as discussed above.

Figure 14:
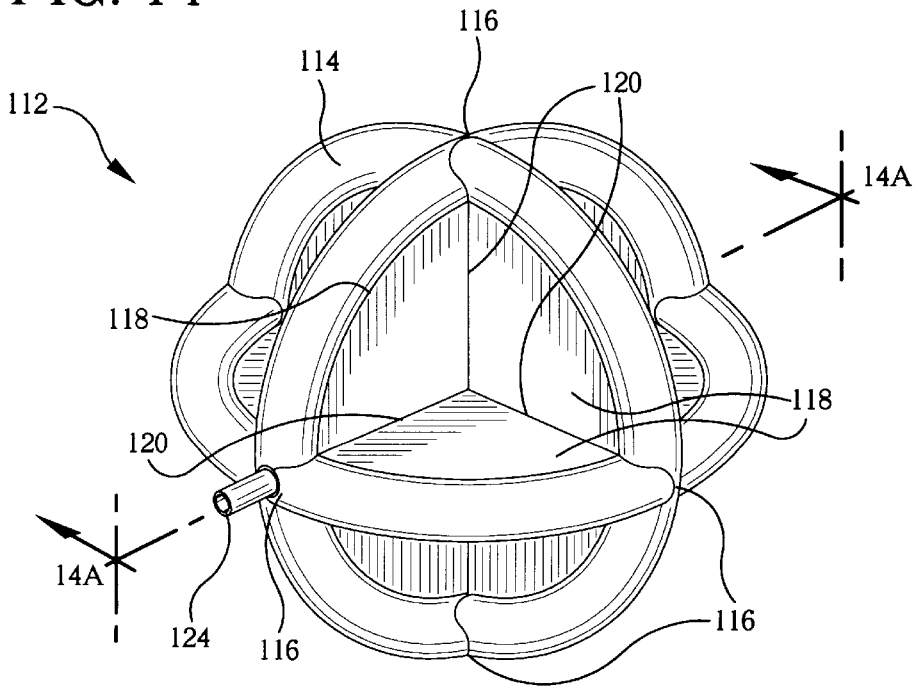
FIGS. 14 and 14A show Applicant's inflatable radar reflector which can be encased within a balloon.
Figure 14A:
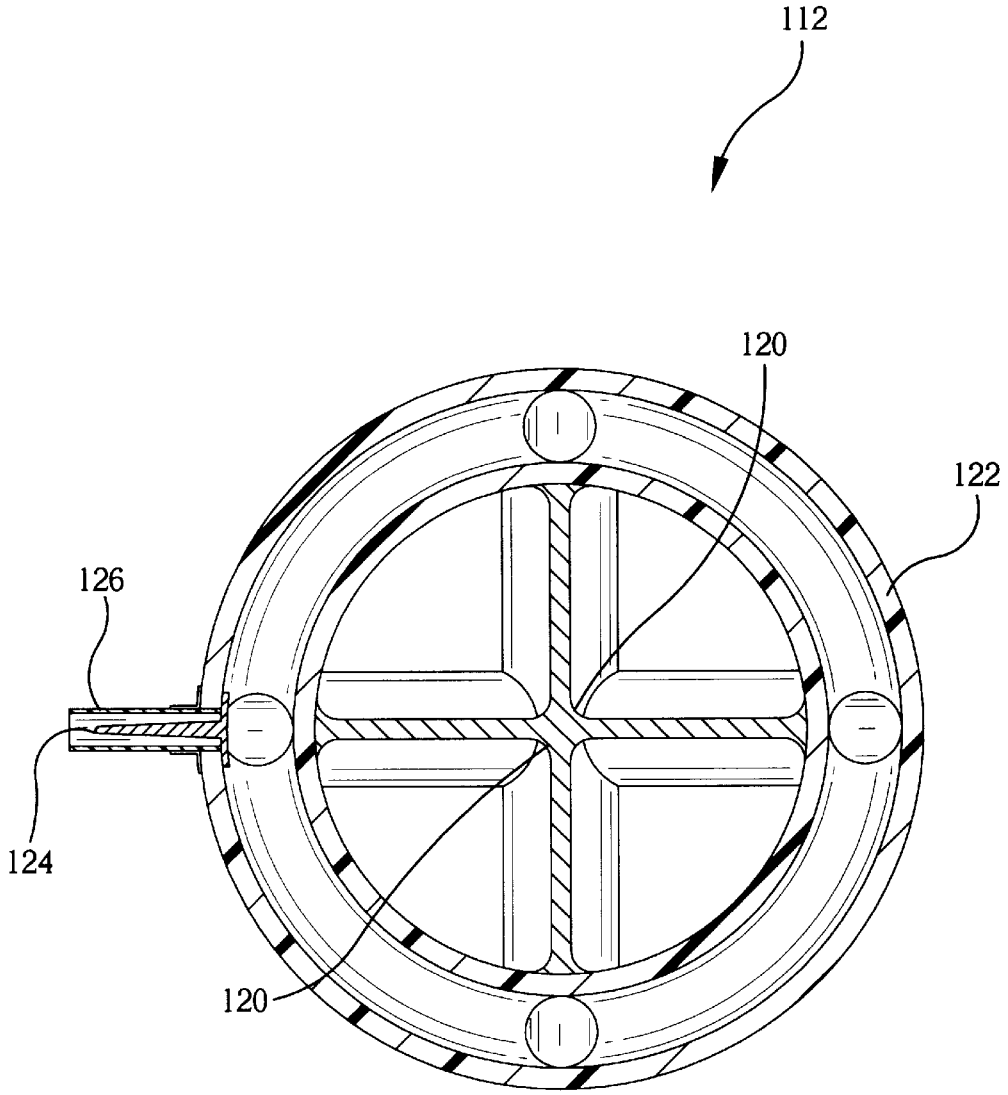

FIGS. 14 and 14A show Applicant's collapsible inflatable radar reflector 112, which also provides three mutally orthogonal reflecting surfaces. The three inflatable hoops (i.e., toruses) 114 are made of elastomeric tubing resembling the tubes for bicycle tires or the like and mutually intersect at points 116 so as to provide a single inflatable air reservoir, with the hoops held in orthogonal position. Thin discs 118 of flexible, radar-reflective material such as aluminized Mylar are fastened securely inside each hoop, mutually intersecting at lines 120 and configured so that the final assembly provides three orthogonal radar-reflective discs. Optionally, to provide protection from the elements and add rigidity for the inflated hoops, the device is encased in a large elastomeric, radar-permeable balloon 122, shown in cross-sectional view in FIG. 14A. The inflation tube 124 of the reflector is led out through the balloon inflation tube 126, so that the reflector unit and balloon may be inflated sequentially or essentially simultaneously. When both units are fully inflated and the inflation tubes secured, the hoops and orthogonal radar reflective surfaces are held firmly in place and protected from the elements. The unit can be collapsed and encased in an envelope or packet for storage in a lifejacket pocket, as described abDve. In conditions of calm or light winds, the unit's hoops and balloon can be at least partially inflated with lighter-than-air gas such as helium or hydrogen so that it is buoyant and does not require a lifting device such as the parafoil. Such gases can be provided by small cartridges, gas generators, or any available source. FIG. 2 illustrates an array of vertical antenna wires (21) which could be suitably connected, e.g. via wire (29), to form a radio antenna, and circular arrays utilizing a metal hoop or wire (8) or a separate wire (23) on the surface of brim (6) can also be used. In some embodiments the radar reflective material incorporated in the hat can be connected and combined with or used as a radio antenna, as in a ground plane. Appropriate antenna types and configurations can be selected by those skilled in the art, according to the environment, frequencies, etc. involved. Miniaturized radio transmitters or other signal means can be incorporated into the structure of the hat (not shown here).

Battery-powered strobe lights are selected from commercial sources so as to be suitable for wear on the crown of the hat, and are preferably designed for long storage life and marine or outdoor use. The use of a strobe light, producing a bright flash at repetition rates ranging from about 20 to about 100, preferably from 50 to 70 times per minute according to Inland Navigation Rules, produces optimum visibility and duration of signal for a given energy level (primarily represented by the weight of the battery). Such strobe lights (and other distress signal means) can be recharged by solar cell material, shown here as (19), such as cited in Applicant's U.S. Pat. No. 4,553,037, which is incorporated herein by reference. Solar cells (19) can be connected to external batteries via wire (31). Power or signals can be sent to active signal means such as antenna (21) via wire (29).

Figure 5:
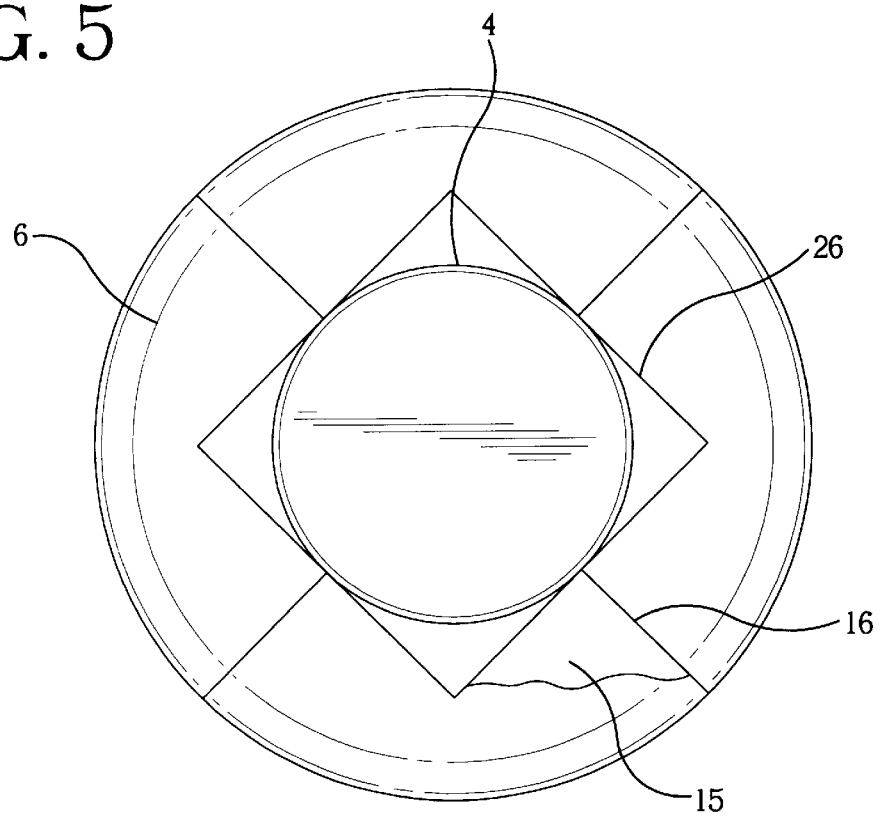
FIG. 5 shows a top view of the hat with rectangular panels addded to the crown.

A survival hat is shown in FIGS. 5, 5A and 5B of the parent and grandparent applications. The hat's broad brim keeps sun off the face and neck and also provides a sizable drawstring bag for storing distress signalling equipment. A survival hood of lightweight material is folded into the crown of the hat, but can be pulled out to protect the top of the shoulders, neck and face from the sun while expanding the area of international orange material displayed as a distress signal. Hook and loop material, snaps and/or rings (not shown) for mechanical attachments on top of the hat provide a place to attach a strobe light and/or small radar reflector shown in FIGS. 13, 14, and 14A. (And/or is used in the conventional sense meaning either or both items.) Reflective tape can be affixed to the hat to enhance visibility or the survivor, by day reflecting sunlight and by night reflecting searchlights, etc.

FIG. 2 shows a section of a similar survival hood (22) which can be used and stowed in the same manner. Additional sections can be included and used to cover the shoulders and face. Also shown in FIG. 2 is a strip of light reflective tape (24), representing light reflecting means which can be applied to at least one surface of the hat. When these light reflecting means are applied over portions of the hat which comprise radar reflective material, those portions become both radar and light reflective surfaces.

Figure 3:
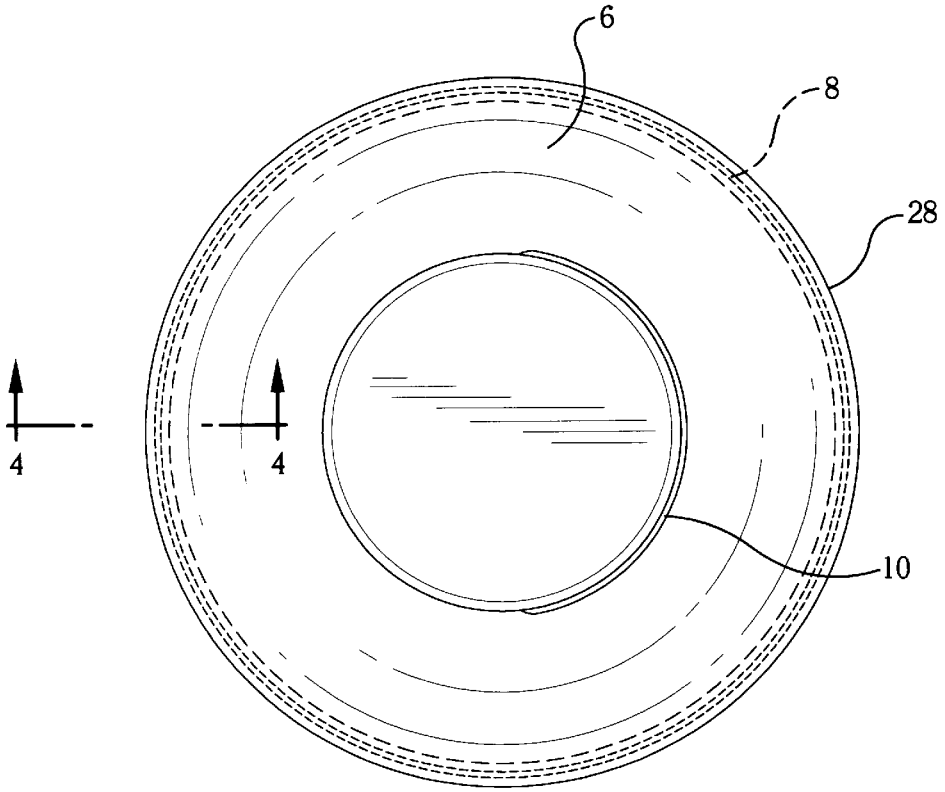
FIG. 3 shows a top view of the hat.
Figure 4:
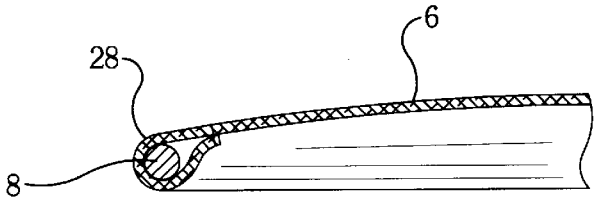
FIG. 4 shows a cross-section of the brim of the hat of FIG. 3.

As shown in FIGS. 1 and 3, the springy hoop or other stiffening means (8) included within the peripheral binder (28) of the hat provides outward pressure to provide a stable, horizontal brim even when relatively lightweight material is used for the hat. FIG. 4 shows the hoop (8) in cross section, illustrating how the hoop, tube or wire can be sewn or otherwise fastened into the peripheral binder (28) of the brim of the hat. The hoop means can be made of any suitable springy material which can be bent repeatedly and recover its original shape when released. For example, spring steel, springy polymeric materials and even bamboo fibers can be used. The tube means which can be installed in the binder can be made of rubber, bidirectional nylon or mylar (as used for party balloons) or other suitable material. Mouth inflation and sealing means (not shown) are provided for the inflatable tube. Wire or other suitable material which is stiff but bendable can provide shape as well as serve as all or part of a radio antenna.

Figure 6:
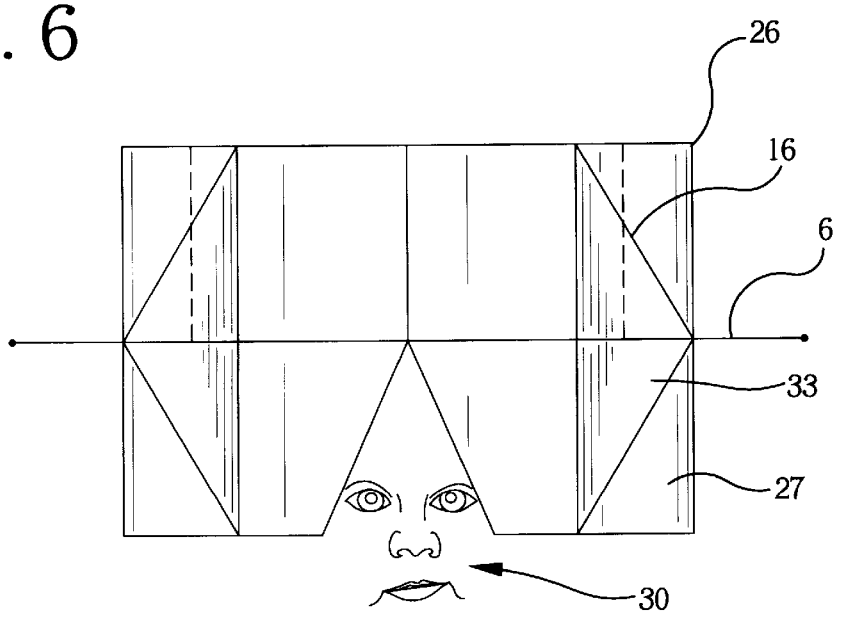
FIG. 6 is a front view of the hat of FIG. 5.

FIGS. 5 and 6 (a front view of the hat of FIG. 5) illustrate additional optional features of the invention. A set of four rectangular panels (26) is attached to the crown (4) at the points of tangency, attached to the brim and to each other at the corners. These panels are made of radar reflective material and augment the radar reflective planar surfaces formed by triangular panels (16) and crown (4). Sets of orthogonal radar reflecting planes are formed by the intersections of these planes, the triangular planes and the adjacent portions of the brim (15) which comprise radar reflective material. The panels can be additionally held in position by removable or foldabLe stiffening means such as inserts of wire, plastic or wood or inflatable tubes (not shown here). The stiffening means would normally be removed or folded before collapsing the crown for folding of the hat. FIG. 6 also shows a set of optional rectangular panels (27) extending below the brim (6) and forming nearly a mirror image of the panels (26) atop the hat. Similar triangular panels (33) are also attached to the brim (6), extending below it to join with the rectangular panels (27). A portion of the panel(s) at the front of the hat is cut away as shown at (30) to permit the wearer to see. The panels and triangular inserts are made of radar reflective material to enhance the radar signal of the hat, like a standard reflector, when the hat is not perfectly level. The panels can be folded up into the crown of the hat when such enhancement is not essential or the hat is to be folded. These optional panels enhance the visual detectability and weather protection afforded by the hat.

Figure 7:
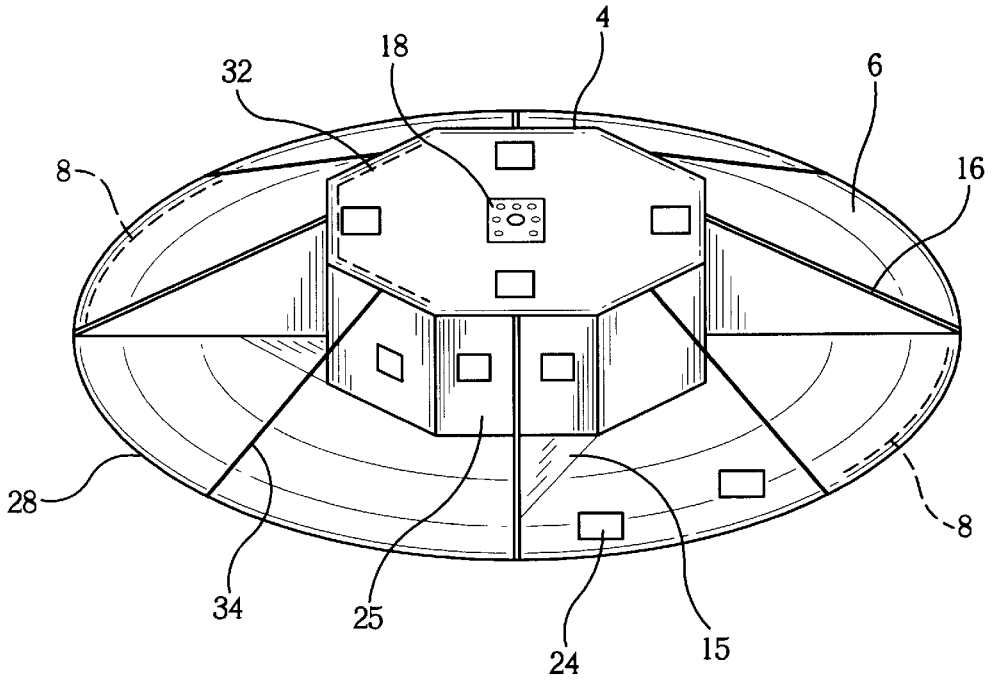
FIG. 7 is a perspective view of an embodiment of the hat featuring an octagonal crown.
Figure 8:
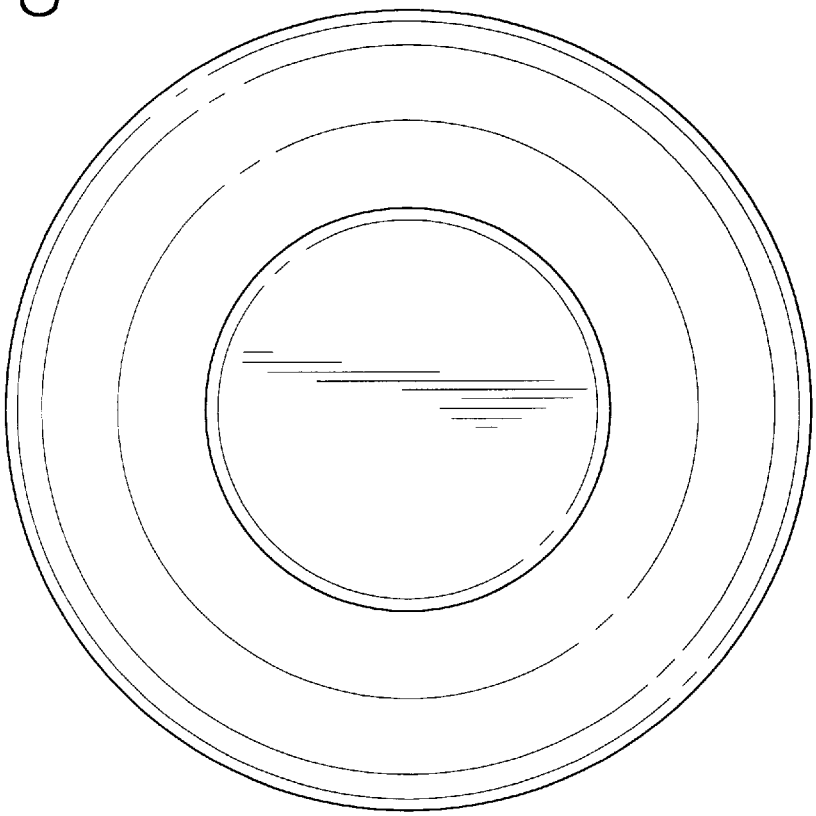
FIGS. 8 to 12 illustrate how the hat can be folded for carrying or storage.

FIG. 7 illustrates other features of the invention in an embodiment in which the crown (4) of the hat has an octagonal cross-section. The triangular planes (16), the adjacent sections (25) of the crown and the adjacent sections (15) of the brim all comprise radar reflective materials, forming a set of eight "corner reflectors" or orthogonal radar reflective planes arranged around the hat to provide retroreflection of radar waves from any azimuth. Fastening means (18) are provided atop the crown for attaching additional signal means, and light reflecting means (24) are arranged around the brim and crown of the hat. The stiffening means (8) in the binder (28) of the brim (6) comprise inflatable tubes, and additional inflatable tubes (32) are provided in the crown to maintain its stiffness and shape when worn. Conductive wires (34) are fastened between the sections of the octagon atop the crown lying between the triangular planes (16) and the outer edges of the brim below. These wires serve to maintain the brim in a stable horizontal position when the hat is worn, and are preferably flexible. These wires can also be used as or integrated into a radio antenna array for communications purposes.

Figure 9:
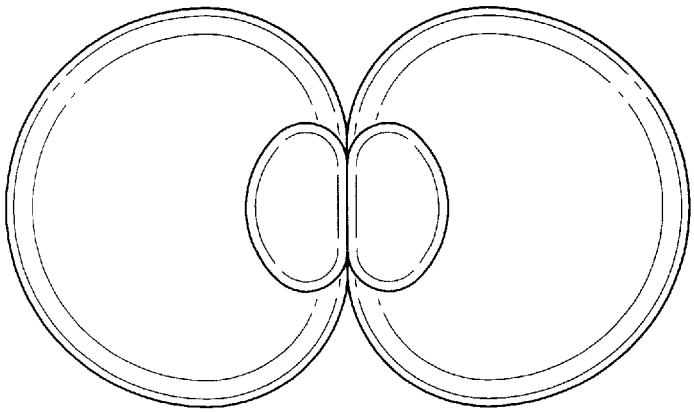
Figure 10:
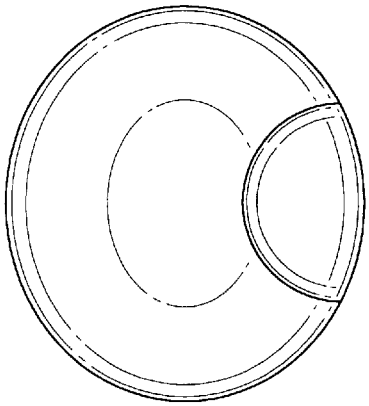
Figure 11:
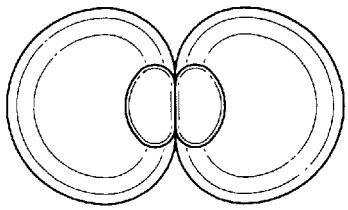
Figure 12:
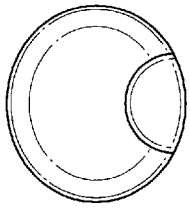

FIGS. 8 through 12 illustrate the process of folding the hat for storage or carrying. When folded into a compact disc as shown in FIG. 12, the hat can be carried in a pocket, purse, life jacket, survival kit, pouch (not shown) or the like. To follow the folding process, it will be easier to visualize the hat without the added panels and triangular panels of FIGS. 5 and 6, although models with these accessories can be folded also. The user takes the hat as shown from above in FIG. 8 (after collapsing the crown and removing any attached distress signals or antennae) and twists the brim from each side approximately 180 degrees to form a figure eight shape as shown in FIG. 9. The two halves of the figure eight are then doubled over each other to form the disc shown in FIG. 10. The process is repeated, twisting the disc of FIG. 10 to form the figure eight of FIG. 11, which is then doubled upon itself to form the disc of FIG. 12, a shape and size suitable for storage or carrying. The process can be repeated if necessary. The final package can be secured from expansion due to the springiness of the hoop in the brim by using fastening means such as at least one rubber band encircling the disc or simply enclosing it in a pouch or other suitable container.

Clearly many modifications and variations of the present invention are possible in view of the above teachings. It is therefore to be understood that the scope of the invention is limited only by the appended claims.

I claim:

1. A foldable hat comprising a collapsible crown and a broad brim surrounding same and having a peripheral binder containing stiffening means therin, wherein said hat can be folded for storage by at least one cycle of twisting the brim into a figure eight shape and folding the halves of said figure eight together and said hat incorporates at least one signal means comprising a strobe light.

2. The foldable hat of claim 1 wherein said stiffening means comprises a springy hoop.

3. The foldable hat of claim 1 wherein said stiffening means comprises an inflatable tube.

4. The foldable hat of claim 1 wherein said stiffening means comprises stiff but bendable wire.

5. The foldable hat of claim 1 which further comprises additional stiffening means in at least one of the crown and brim of the hat.

6. The foldable hat of claim 5 wherein said additional stiffening means comprise connecting means between the top of said crown and the peripheral edge of said brim.

7. The foldable hat of claim 1 wherein said crown is cylindrical in form.

8. The foldable hat of claim 1 wherein said crown is octagonal in form.

9. The foldable hat of claim 1 which comprises fastening means atop said crown.

10. The foldable hat of claim 9 wherein at least one signal means is affixed to said crown using said fastening means.

11. A foldable hat comprising a collapsible crown and a broad brim having a peripheral binder containing stiffening means therein, further comprising fastening means atop said crown and at least one signal means comprising a strobe light and affixed to said crown using said fastening means, wherein said strobe light is powered by a battery which is rechargeable with solar cell means attached to said hat.

12. A foldable hat comprising a collapsible crown and a broad brim having a peripheral binder comprising stiffening means therein, further comprising fastening means atop said crown, wherein a radar reflector is affixed to said crown using said fastening means.

13. A foldable hat comprising a collapsible crown and broad brim having a peripheral binder containing stiffening means therein, and further comprising fastening means atop said crown wherein at least one radio antenna is attached to said crown using said fastening means.

14. The foldable hat of claim 1 which comprises radar reflective materials.

15. A foldable hat comprising a collapsible crown and a broad brim having a peripheral binder containing stiffening means therein, and comprising radar reflective materials, wherein said radar reflective material forms at least one set of three mutually orthogonal planar surfaces.

16. The foldable hat of claim 1 which comprises light reflecting means.

17. The foldable hat of claim 16 wherein said light reflecting means comprise reflecting tape.

18. A foldable hat comprising a collapsible crown and a broad brim having a peripheral binder containing stiffening means therein, and comprising radar reflector materials, wherein said radar reflective materials are combined with at least one radio antenna to form a desired radio antenna pattern.

19. The foldable hat of claim 1 which comprises a survival hood which is foldable into said crown.

20. A foldable hat comprising a cylindrical collapsible crown having fastening means on the top thereof with signal means comprising a strobe light attached thereto, a relatively broad brim having a peripheral binder containing a springy hoop there in and a survival hood foldable into said crown.

21. A foldable hat comprising a cylindrical collapsible crown, a relatively broad brim having a peripheral binder containing a springy hoop therein, and radar reflective material forming at least one set of three mutually orthogonal planar surfaces, said hat further comprising light reflecting means.

22. The foldable hat of claim 21 wherein two of said orthogonal planar surfaces are formed by triangular planes extending between said crown and said brim and adjacent portions of said crown, respectively, and the third planar surface is formed by at least a portion of said brim.

23. The foldable hat of claim 12 wherein said stiffening means comprises a springy hoop.

24. The foldable hat of claim 12 wherein said stiffening means comprises an inflatable tube.

25. The foldable hat of claim 12 wherein said stiffening means comprises a stiff but bendable wire.

26. The foldable hat of claim 12 wherein said crown is octagonal in form.

27. The foldable hat of claim 15 wherein said stiffening means comprises a springy hoop.

28. The foldable hat of claim 15 wherein said stiffening means comprises an inflatable tube.

29. The foldable hat of claim 15 wherein said stiffening means comprises a stiff but bendable wire.

30. The foldable hat of claim 15 wherein said crown is octagonal in form.

31. The foldable hat of claim 20 which further comprises additional stiffening means in at least one of the crown and brim of the hat.

32. The foldable hat of claim 20 which comprises radar reflective materials.

* * * * *